US009574297B2

(12) United States Patent
Berndsen et al.

(10) Patent No.: US 9,574,297 B2
(45) Date of Patent: Feb. 21, 2017

(54) FLOATING DRUM AND CLUTCH FOR TOP-LOADING WASHING MACHINE

(75) Inventors: Rodrigo Strzelecki Berndsen, Curitiba (BR); Felipe Augusto Scheer, Curitiba (BR); Marcelo Piekarski, Curitiba (BR); Cirilo Alex Cavalli, Curitiba (BR); Álvaro Volpato Junior, Curitiba (BR)

(73) Assignee: Electrolux Do Brasil S/A, Curitiba PR (BR)

( * ) Notice: Subject to any disclaimer, the term of this patent is extended or adjusted under 35 U.S.C. 154(b) by 587 days.

(21) Appl. No.: 14/235,668

(22) PCT Filed: Jul. 30, 2012

(86) PCT No.: PCT/BR2012/000257

§ 371 (c)(1),
(2), (4) Date: Jun. 2, 2014

(87) PCT Pub. No.: WO2013/016792

PCT Pub. Date: Feb. 7, 2013

(65) Prior Publication Data

US 2014/0305173 A1 Oct. 16, 2014

(30) Foreign Application Priority Data

Jul. 29, 2011 (BR) ..... 1103238

(51) Int. Cl.
*D06F 37/40* (2006.01)
*D06F 13/02* (2006.01)

(52) U.S. Cl.
CPC ..... *D06F 37/40* (2013.01); *D06F 13/02* (2013.01)

(58) Field of Classification Search
CPC ..... D06F 37/40; D06F 13/02
See application file for complete search history.

(56) References Cited

U.S. PATENT DOCUMENTS

| | | | |
|---|---|---|---|
| 2,665,576 | A | 1/1954 | Thiele |
| 5,651,277 | A | 7/1997 | Richardson |
| 2003/0074931 | A1 | 4/2003 | Lee et al. |

FOREIGN PATENT DOCUMENTS

| | | |
|---|---|---|
| GB | 2 287 960 | 10/1995 |

OTHER PUBLICATIONS

International Search Report mailed Feb. 26, 2013 in corresponding International Application No. PCT/BR2012/000257.

*Primary Examiner* — Michael Barr
*Assistant Examiner* — Rita Adhlakha
(74) *Attorney, Agent, or Firm* — Banner & Witcoff, Ltd.

(57) ABSTRACT

A floating basket and clutch are applied to a top loading washing machine. More particularly, the basket floating (1) and clutch (2) are applied to top loading washing machines (M), equipped with a motor (M) and a drive system which includes a drive shaft (E), a pulley (P), a belt (Cr) and a sealing device (V), assembled between the shaft (E) and the base of the tub (T). More precisely, the clutch (2) is responsible for commanding the operation of the oscillating movement of the agitator or impeller (AG), during the washing operation (OPL) and operating the high-speed spinning of the agitator (AG) and basket (1), when operating in centrifugation operation (OPC). The floating basket (1) is coupled and fixed to the tube (5) of the upper sector (S1) of the clutch (2) and the tub (T) is fixed to the female lower crown (4) of the lower sector (S2) of the clutch (2). The floating basket (1) has vertical displacement (x) in relation to the tub (T), along the drive shaft (E) according to presence or absence of water (A) in the tub (T) of the washing machine (ML). The upper sector (S1) of the clutch (2) is made up of a male upper crown (3) and fixed in the stationary end (E1) of the drive shaft (E) and an female upper crown (6) is fixed to the tube (5) with screws (P2). The lower sector (S2) of the clutch (2) comprises the male lower (Continued)

crown (7), fixed to the tube (5) with screws (P3) and the female lower crown (4) fixed and stationary in the tub (T) by screws (P).

18 Claims, 9 Drawing Sheets

FLOATING DRUM AND CLUTCH FOR TOP-LOADING WASHING MACHINE

FIELD OF THE INVENTION

An embodiment of the present invention relates to a floating basket and clutch applied to top loading washing machines and more particularly, the object of this application includes the combination of a floating basket coupled to a set of clutch parts which moves vertically and along the drive shaft, depending on the presence or absence of water in the basket of the machine; the floating basket and clutch set allows that the functions of washing and centrifugation are performed with a reduced number of parts and a high efficiency when compared to conventional models.

INVENTION BACKGROUND

It is known that "top loading" washing machines are devices with a top door that includes a tub, a basket and an agitator or "impeller", mounted on a vertical shaft. Most models of "top loading" washing machines have a vertical shaft that is coupled to a drive system consisting of a motor, transmission (gearbox) and clutch.

In general, the clutch work of a washing machine is that of allowing the motor and the transmission to operate, as programmed, within certain variations in the output rotational speed of the vertical shaft, to which the agitator and basket are bound in order to carry out, on its program, the washing operation, i.e., the oscillating movement of the agitator in relation to the basket, and where soap and water are stirred between fabrics, removing the dirt from them. After some periods of stirring, the agitator and basket are stopped, which allows the washing water to be drained, so that in a final operation the agitator and basket are driven in a manner that they spin together, and at high speed, characterizing the operation of centrifugation that expels the excess water retained in clothes and fabrics.

Most of conventional clutches use a gear mechanism and springs for changing the transmission of the motor power between the washing and dewatering steps. The conventional clutch springs provide a way of carrying out power transmission among the motor and the agitator and the basket.

Each conventional clutch spring requires high precision in their laps, and depends on calculations relating to its inner diameter, among others. In addition, to control the movement of the clutch springs, electro-magnet, actuators, lever arms and other components are required. Therefore, the conventional clutch mechanism has a complicated construction, resulting in an increased production cost.

Currently there are several types of clutches for different types of "top loading" machines and most of them are somewhat complex, even for simpler applications.

Analysis of the State-of-the-Art

Some manufacturers of washing machines have already had technical solutions that use floating clutches based on the principle of presence or absence of water in the tub to promote the movement of washing and centrifugation.

A brief survey in databanks revealed solutions included in the scope of this application, i.e., a floating movement of some parts assembled on the drive shaft of the automatic washing machine in order to perform the washing and spinning movement. However, as it will be explained, an aspect of the present invention shows a new and inventive solution against the traditional clutch systems, i.e., the vertical displacement of the floating basket associated to a clutch mechanism which does not require the employment of the transmission system, and therefore, having significant advantages in terms of efficiency and reliability for performing the washing machine innovative operations of washing and centrifugation, as well as it proved to be more affordable to manufacturing and assemble and, consequently, to reduce the cost of the final product.

An example of a system that uses floating clutch and requires transmission system, unlike the object of this document, is the Brazilian document No. PI 0605507-9 (Mabe) that refers to a floating clutch with two concentric shafts, where through a movable body it is possible to transmit energy from one shaft to another, through an indented disc which engages or disengages by vertical displacement in a cylindrical part, fixed to the agitator, due to the presence of some fluid, transmitting the torque of the inner shaft coupling, and from this one to the other parts. The motor is DD (direct drive) type and transmits power to the set of shafts through the transmission system.

Another American document No. U.S. Pat. No. 5,661,990 (DAEWOO) has no transmission system, but uses the gearing of a set of floating pieces and the floating impeller whose drive shaft has a DD motor assembled directly on it, producing the stress directly, differing from the proposal exposed as follows.

SUMMARY OF SELECTIVE INVENTIVE ASPECTS

Based on the above considerations, the floating basket and clutch assembly applied to a washing machine with agitator has as its main objective, to provide that a top loading washing machine has specific constructiveness in order to engage, in a specific and efficient way, the mechanism of the floating basket and the gear assembly to perform the functions of washing and centrifugation.

For this, the set of floating basket and clutch includes a drive shaft that: (i) at the lower end it receives the rotation command from the motor, (ii) at the upper end it is coupled to the base of the agitator or the impeller, and this requires the oscillating movement and, (iii) in the middle area, it provides ways that allow a vertical displacement of the basket in order to perform the operation of centrifugation.

In order to achieve the above objectives, at the very end of the shaft, a first gearing mechanism is fixed, composed of a cylindrical bearing with external radial dents, while in the middle area of that shaft, other cylindrical bearing with internal dents is placed which, in turn, is fixed at the base inside the tub.

This time, between the fixed upper and lower bearings, a floating mechanism operates, made up by the floating basket that can be coupled to a set of three floating parts of clutch, movable vertically, where two of them are called 'crown', upper and lower, each provided with internal and external dents, which may engage in the upper and lower bearings mentioned above. The central part of the floating set comprises of a chamber or inverted cup whose upper base is fixed with screw to the upper floating crown and the lower base of this cup is also fixed with screw to the floating basket and to the lower crown, forming thereby a floating set that can be engaged and disengaged from the fixed bearing.

The driving of the washing function or centrifugation is carried out by the presence or absence of water in the floating set. Therefore, when water is present in the wash tub, the basket moves upwards vertically along the drive shaft, by disengaging the fixed upper bearing assembly, however engaging it to the fixed lower bearing assembly, stopping, this way, the basket and allowing the shaft to impose the oscillating movement to the agitator, to wash the clothes.

When water is drained from the tub, the whole floating set moves down, i.e., displaces down along the drive shaft, allowing the set to be engaged to the fixed upper bearing and disengaged from the lower fixed bearing, which allows the shaft, the agitator and the basket to form a single piece capable of spinning together at high speeds, performing the function of centrifugation.

This embodiment of the invention is simple and eliminates the need to employ several other conventional components, thereby reducing costs without comprising the operation of agitation and centrifugation.

The sets of upper and lower gearing are easy to produce and avoid or reduce considerably the labor for maintenance, not to mention that, if there is a need for replacement of any parts of the gearing sets, the cost is low in the market, since parts are made of plastic.

BRIEF DESCRIPTION OF THE DRAWINGS

To complement this description in order to obtain a better understanding of the characteristics of the present invention, and according to a preferred practical presentation, a set of schematic drawings with description are attached and showed below, where in an exemplified manner, among others, the following has been represented.

Figure 1:
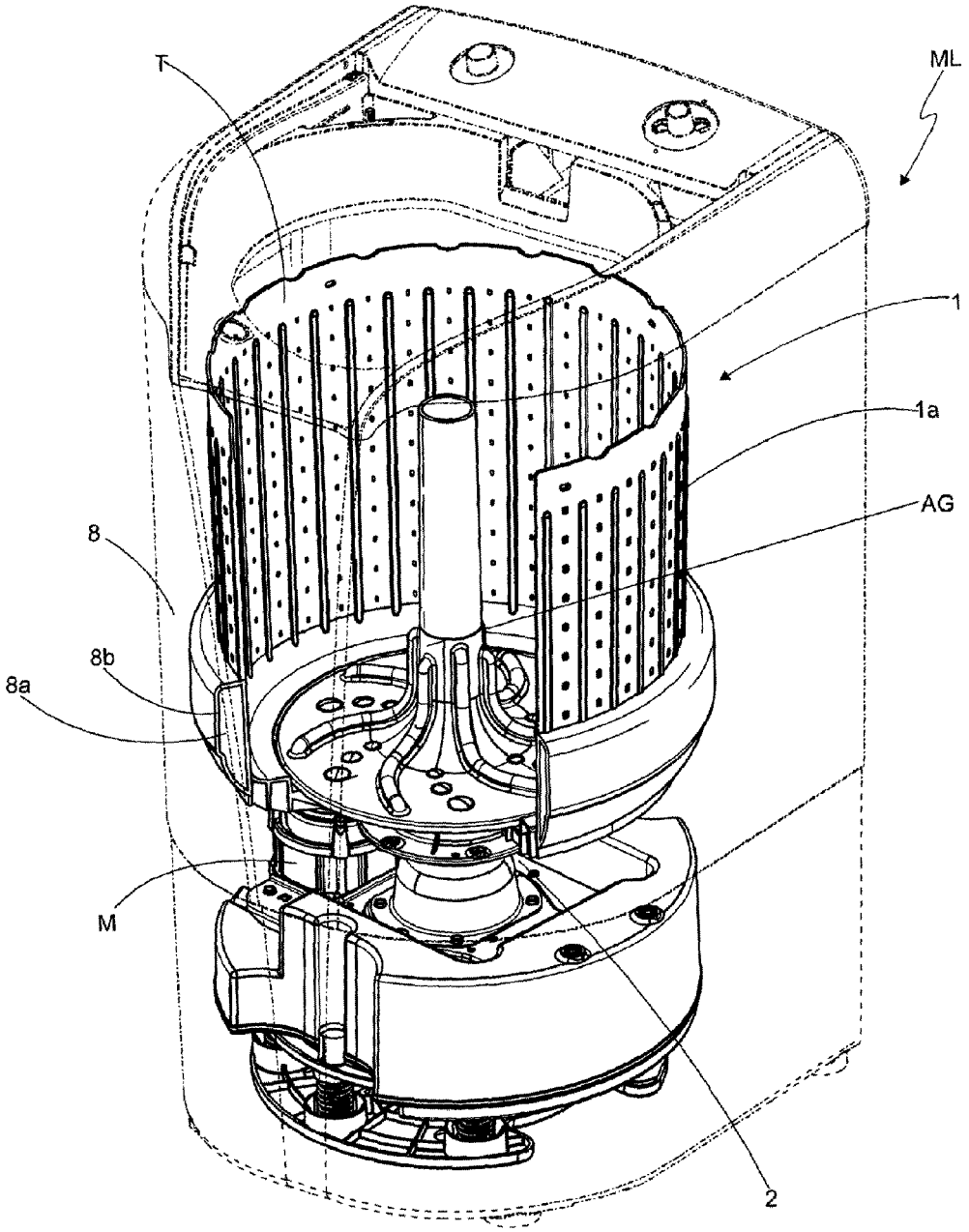
FIG. 1 is a perspective view of a top loading washing machine, illustrating the basket and the agitator in evidence, and the driving system formed by the motor, pulley, belt and drive shaft.
Figure 2:
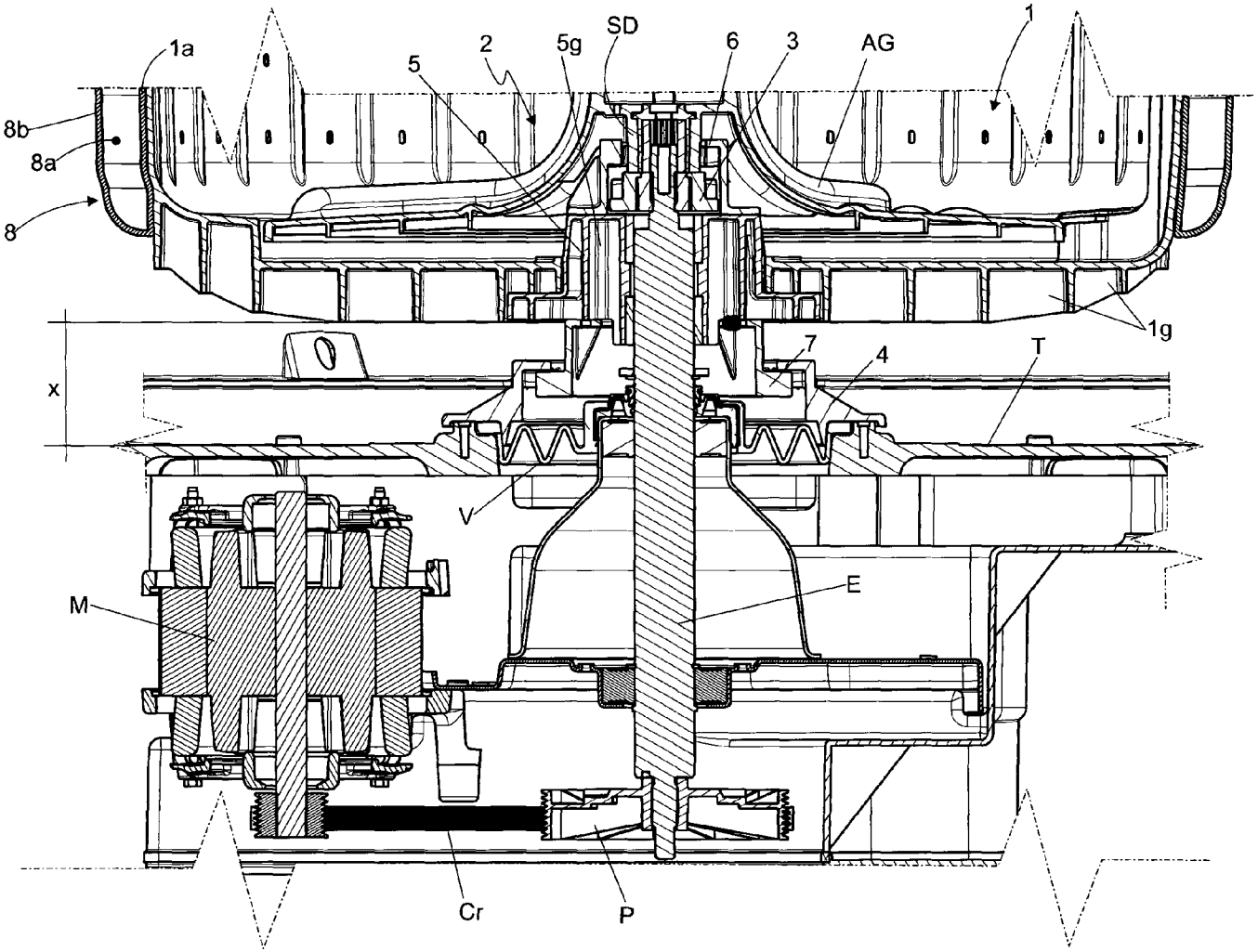
FIG. 2 is a side view, in enlarged section of the whole innovative assembly, i.e., floating basket, drive shaft, fixed bearings and small motor.
Figure 2A:
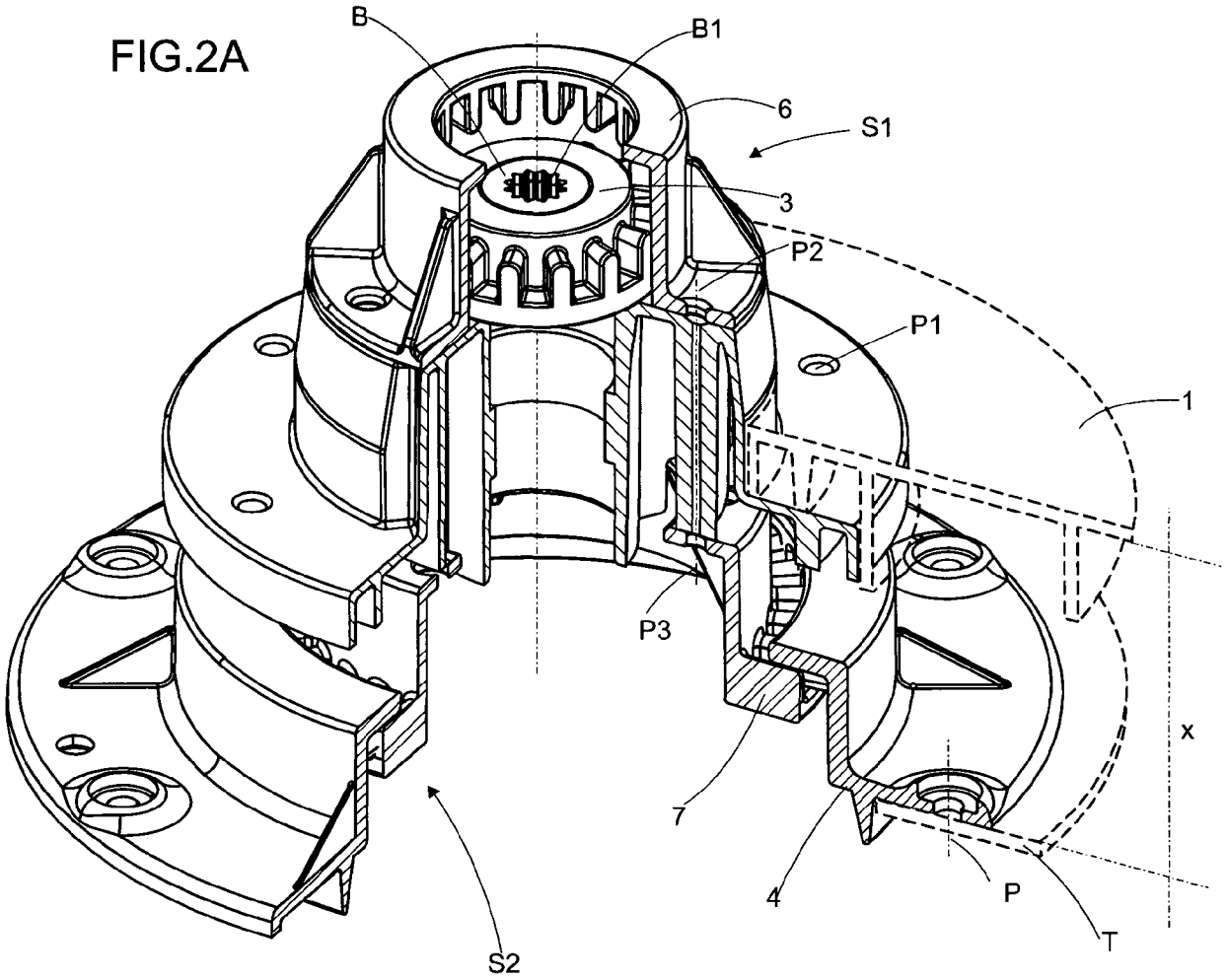
FIG. 2A is a perspective view and partial section of the elements that make up the clutch and the fixed bearings.
Figure 3A:
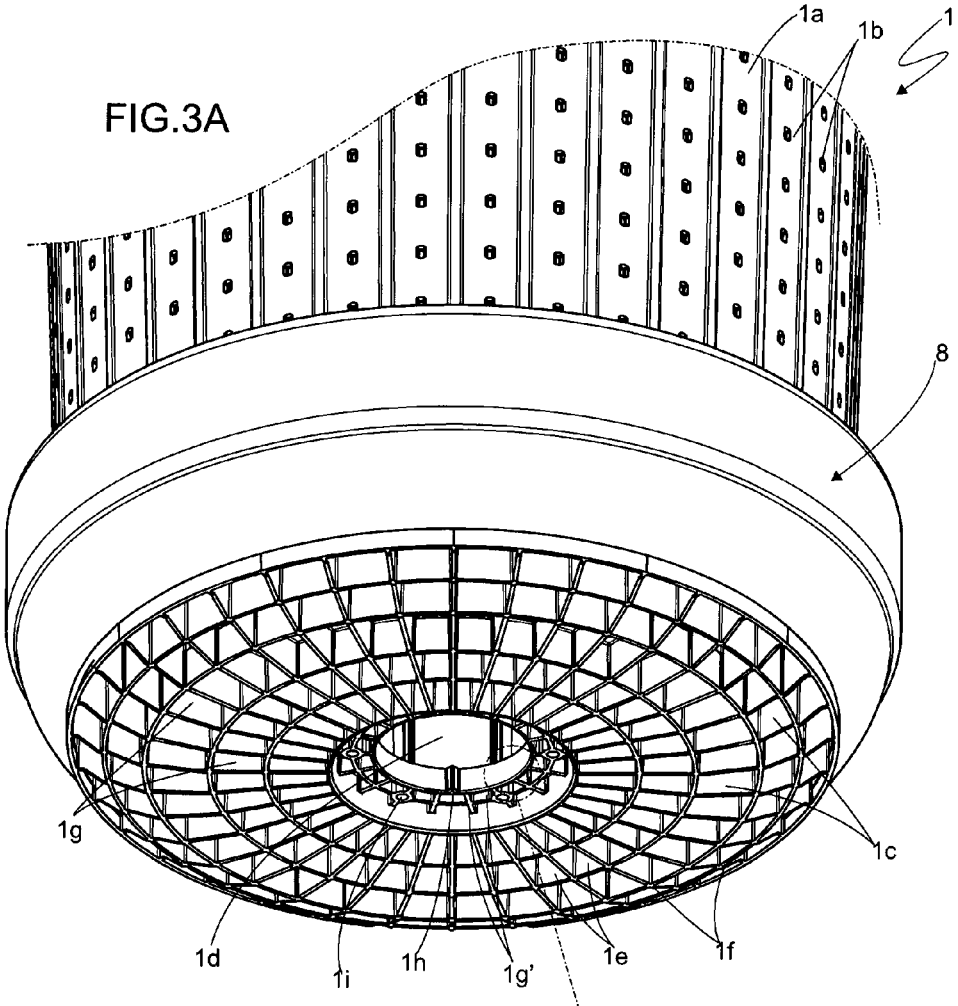
Figure 3B:
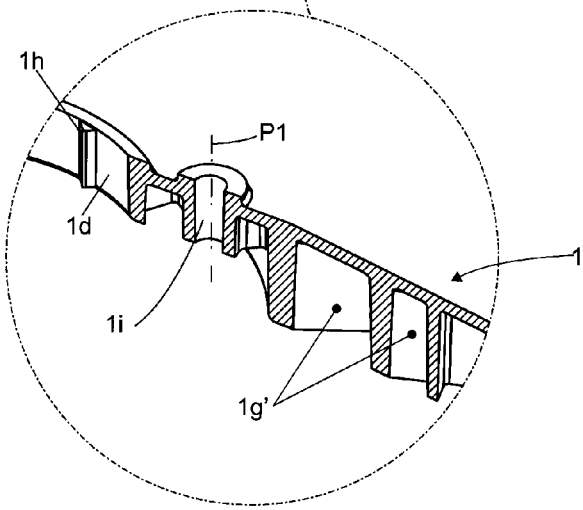
Figure 4A:
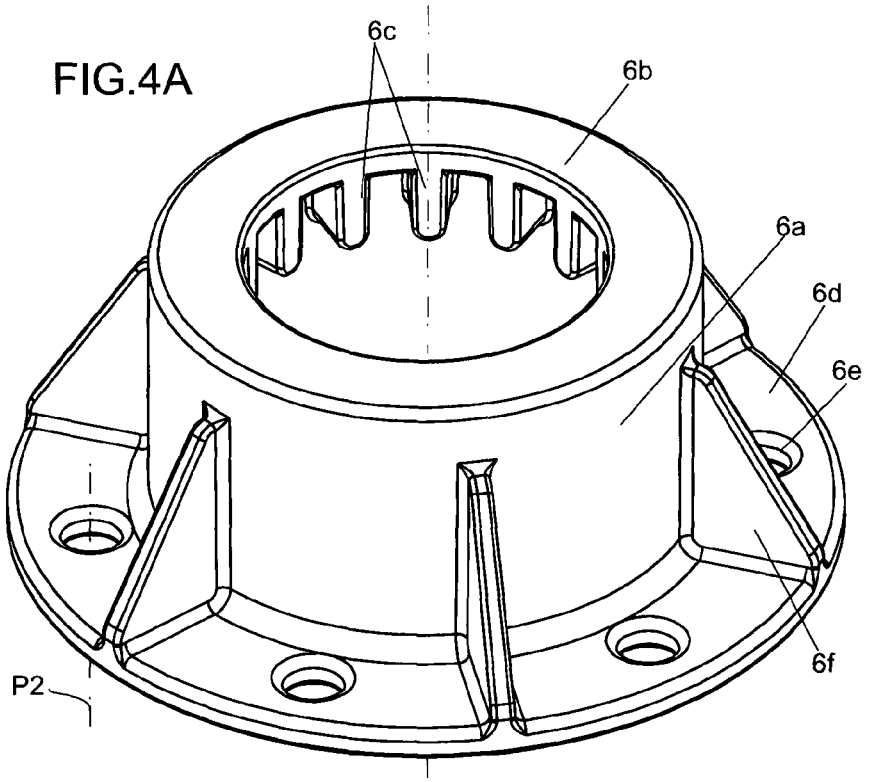
Figure 4B:
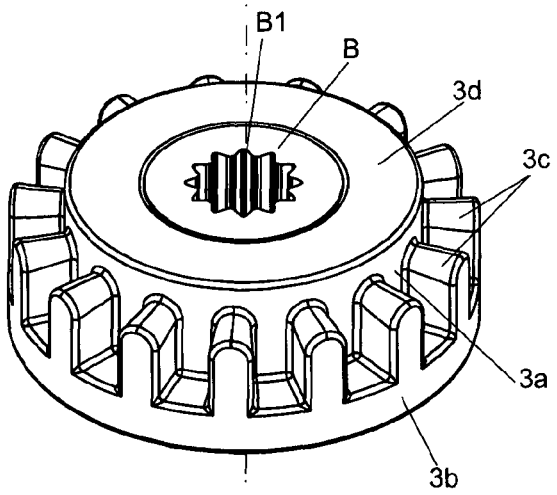
Figure 4C:
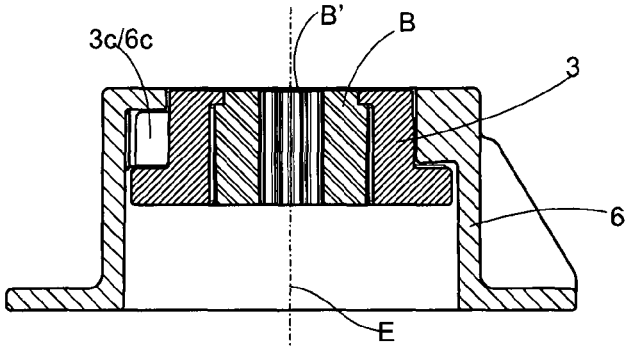
Figure 5A:
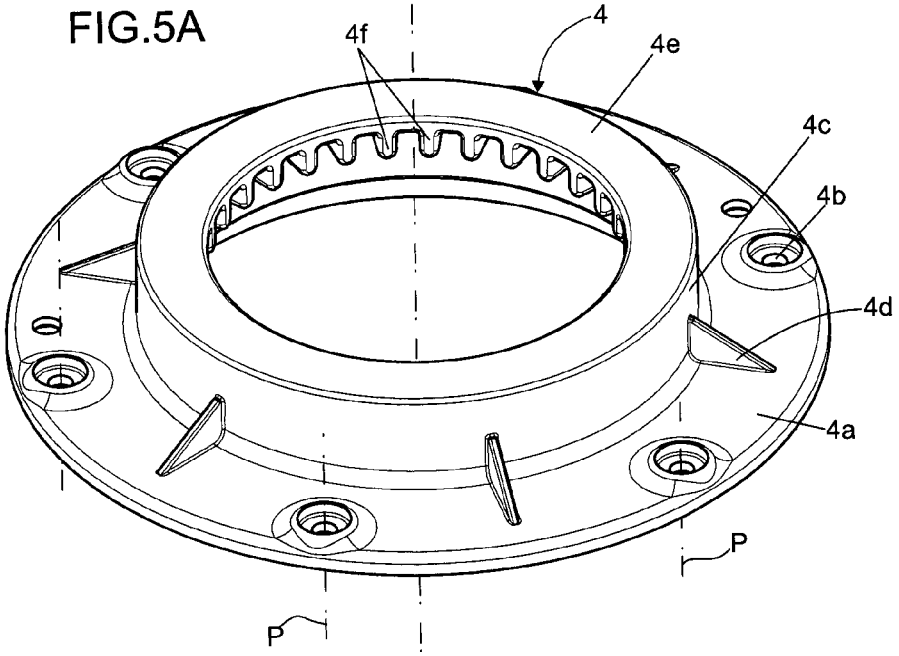
Figure 5B:
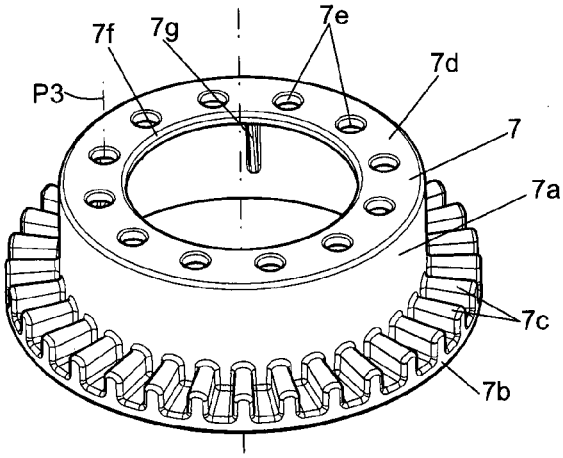
Figure 5C:
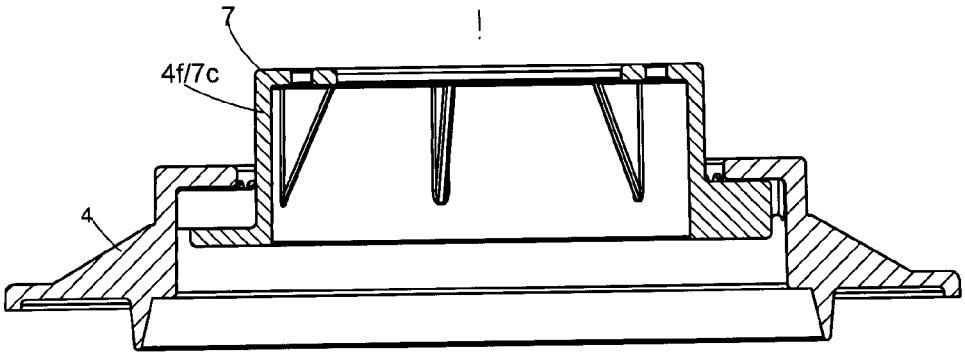
Figure 6A:
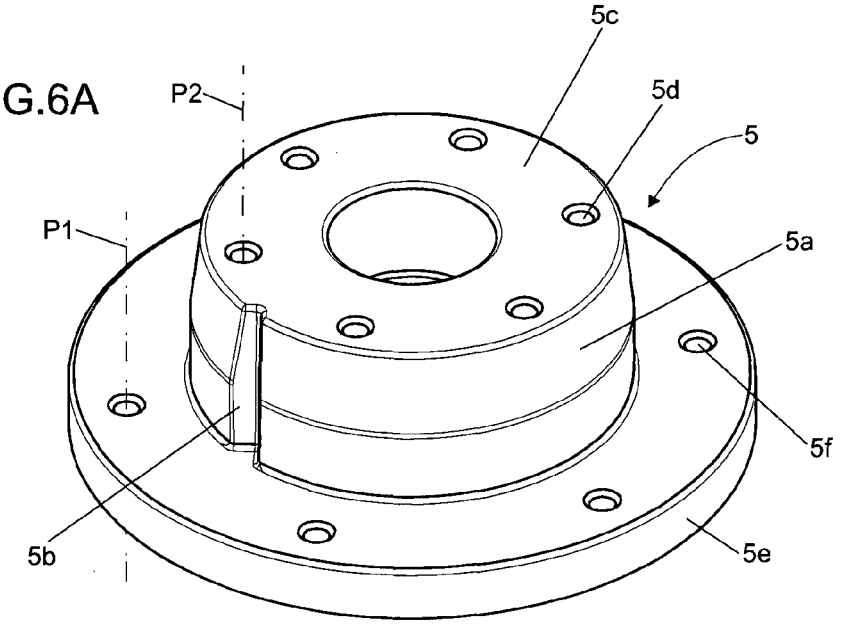
Figure 6B:
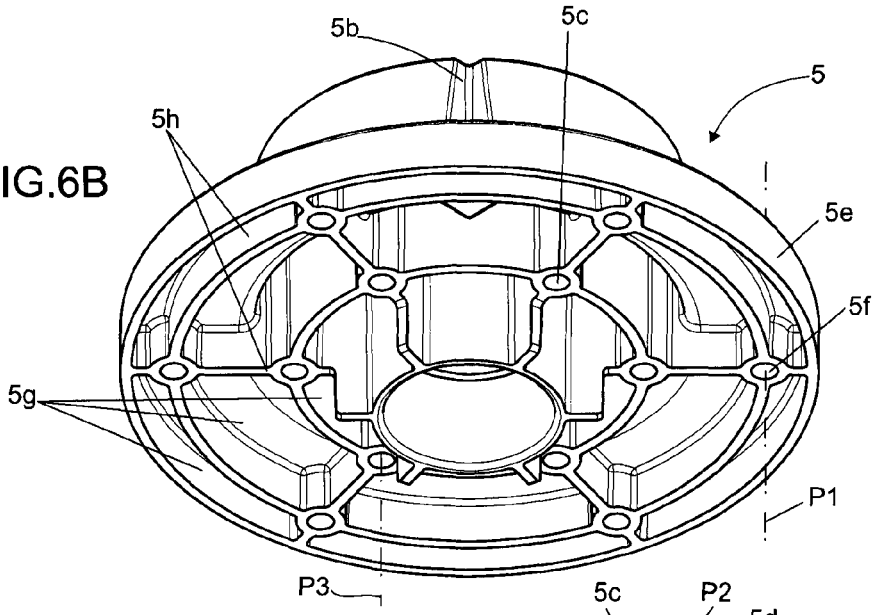
Figure 6C:
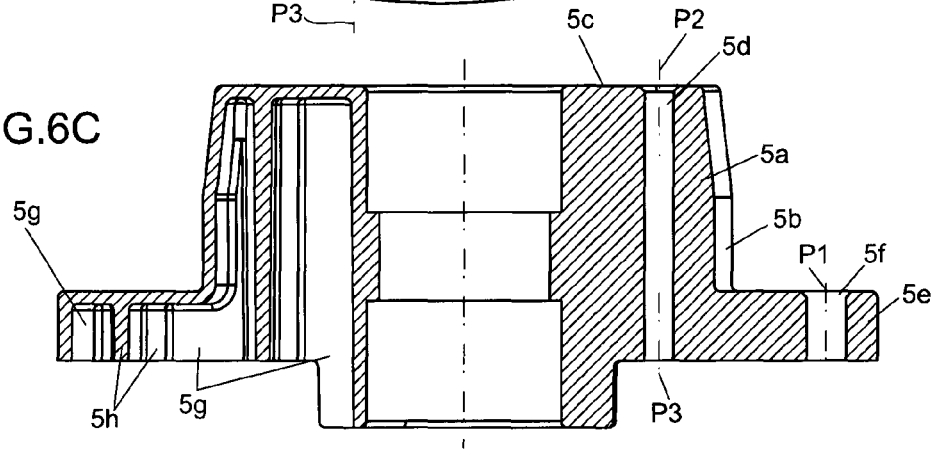
Figure 7:
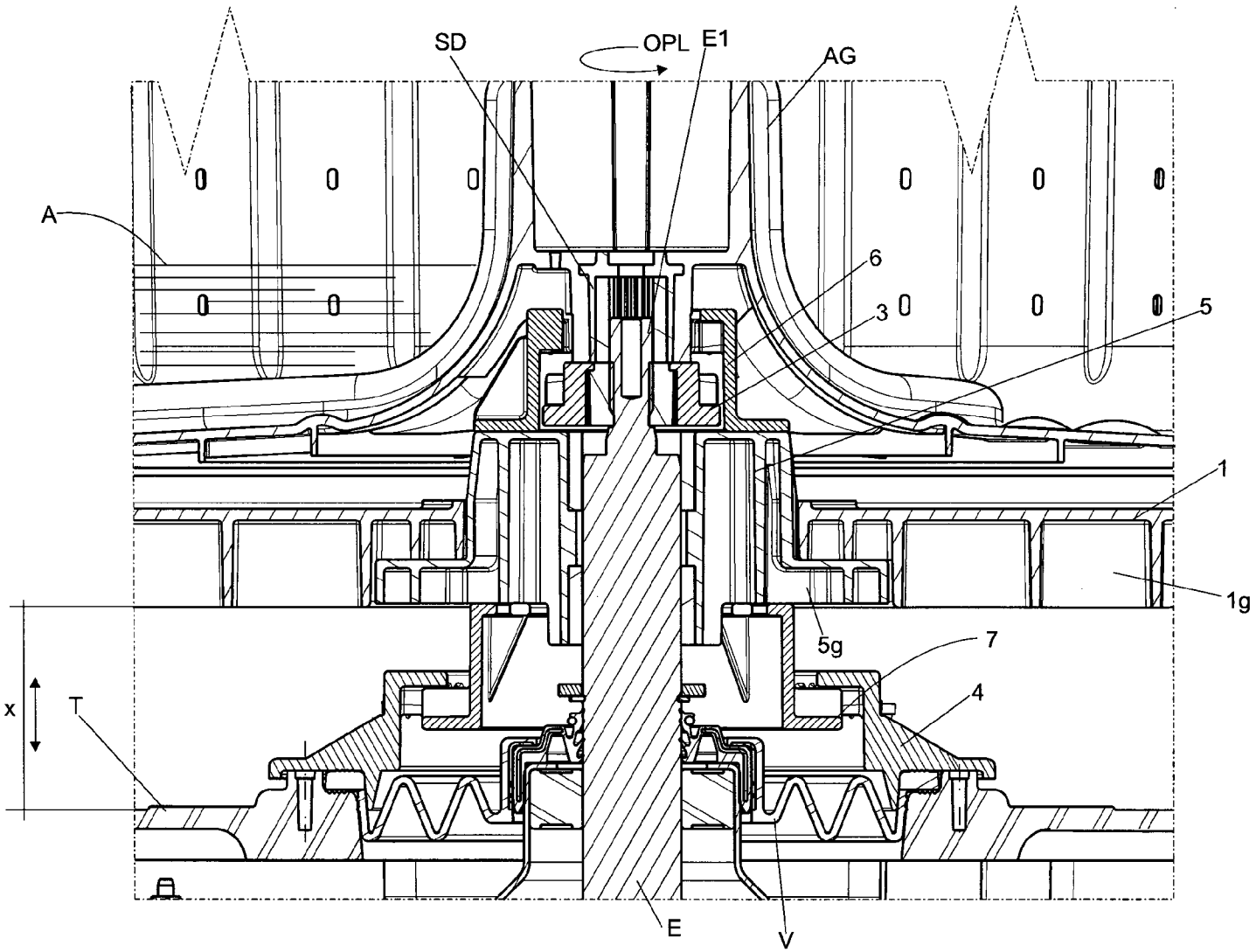
Figure 8:
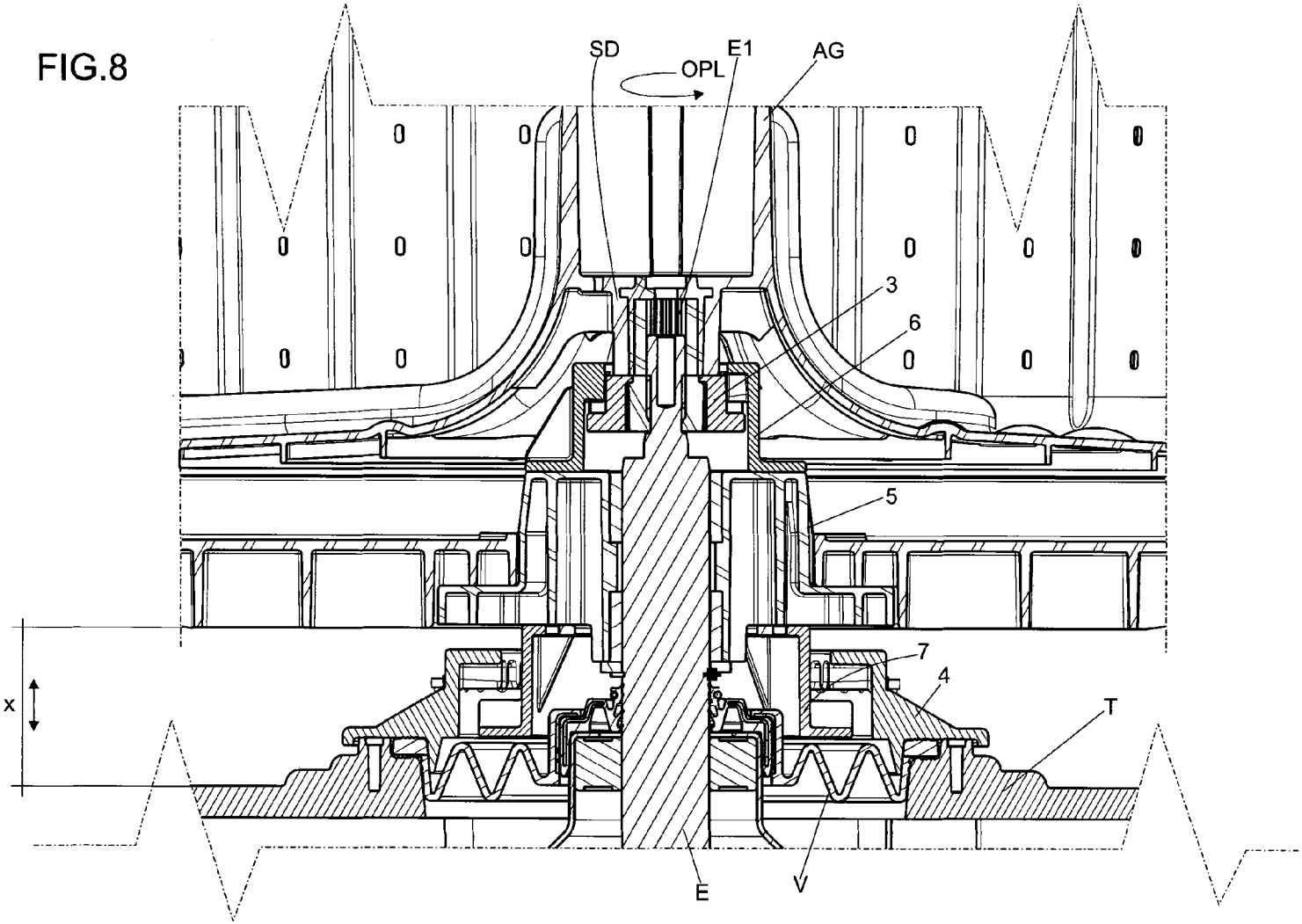

To complement this description in order to obtain a better understanding of the characteristics of the present invention, and according to a preferred practical presentation, a set of schematic drawings with description are attached and shown below, where in an exemplified manner, among others, the following has been represented:

FIG. 1 is a perspective view of a top loading washing machine, illustrating the basket and the agitator in evidence, and the driving system formed by the motor, pulley, belt and drive shaft;

FIG. 2 is a side view, in enlarged section of the whole innovative assembly, i.e., floating basket, drive shaft, fixed bearings and small motor;

FIG. 2A is a perspective view and partial section of the elements that make up the clutch and fixed bearings;

FIGS. 3A and 3B show a lower view (bottom) of the basket and an enlarged side sectional view of the base of the basket, illustrating the floating chambers;

FIGS. 4A, 4B and 4C respectively show the fixed upper bearing and the upper crown in perspective and lateral view of both in the assembled position;

FIGS. 5A, 5B and 5C respectively show the fixed lower bearing and the lower crown in perspective and the side view of both in the assembled position;

FIGS. 6A, 6B and 6C represent, in detail and in upper and lower perspective, the intermediate floating chamber that integrates the clutch relating to the base of the basket;

FIG. 7 is a side view and in section of a washing machine with enough water to proceed with the washing operation, illustrating in enlarged detail the upper gearing assembly engaged and the lower gearing in disengaged position, which allows the agitator to oscillate and that the basket remains stationary, and FIG. 8 illustrates another view as presented in the previous Figure, but the washing machine is without water, in a position to start the centrifugation procedure, where it can be noted in more details, that the upper gearing set is disengaged and the lower gearing set is engaged, allowing that the agitator and the basket agitate together and at high speed.

EXAMPLE EMBODIMENTS

With reference to the drawings, an aspect of the present invention refers to "FLOATING BASKET AND CLUTCH APPLIED TO TOP LOADING WASHING MACHINE, more particularly, the floating basket (1) (i.e., the basket) and the clutch (2) are applied to top loading washing machines (ML), equipped with a motor (M) and drive system which includes a drive shaft (E), pulley (P) and belt (Cr) as well as a sealing device (V) assembled between the shaft (E) (i.e., drive shaft) and the base of the tub (T) (i.e., washtub); more precisely, the clutch (2) is responsible for commanding the operation of the agitator oscillating or "impeller" (AG), when in washing operating (LGA) (FIG. 7) of fabrics and operating at high-speed rotation of the agitator (AG) and basket (1), when in centrifugation operation (OPC) of clothes (FIG. 8).

According to an aspect of the present invention, the floating basket (1) is coupled and fixed to the tube (5) (i.e. connecting member) of the upper sector (S1) of the clutch (2) with screws (P1) and the tube is fixed to the female lower crown (4) of the lower sector (S2) of the clutch (2), so that the basket moves vertically (x) in relation to the tub along the drive shaft (E) in the presence or absence of water (A) in the tub (T) of the washing machine 10 (ML) (FIGS. 7 and 8).

The upper sector (S1) of the clutch (2) is made up of a male upper crown (3) (i.e.. lower engagement part) fixed and stationary at the end (El) of the drive shaft (E), which allows axial and external displacement of a female upper crown (6) (i.e., upper part of the clutch), duly attached to the tube (5) with screws (P2).

The lower sector (S2) of the clutch (2) is composed of a male lower crown (7) fixed to the tube (5) with screws (P3) and a female lower crown (4), as already mentioned, fixed and stationary in the tube (T).

The vertical displacement (x) between the basket (1) and the clutch (2) is based on the fact that the male upper crown (3), fixed to the end (El) of the shaft (E) and the female lower crown (4), being fixed to the tub (T), determines an optimum spacing for the vertical displacement (x) of the set of parts made up by the floating basket (1), female upper crown (6), tube (5) and male lower crown (7) the presence or absence of water (A) in the tub.

The basket (1) is composed of cylindrical side wall part (1*a*), multiperforated (1*b*) and lower base (1*c*) provided with central hole (1*d*) for the drive shaft passing over (E). The lower surface of the base (1*c*) is provided with multiple small orthogonal walls arranged radially (1*e*) and concentrically (1*f*), forming multiple floating chambers (1*g*). The internal wall of the central hole (1*d*) has a directional lock in jut (1*h*) for assembling and coupling to the lowering (5*b*) provided on the tube (5), whereas the area around the central hole wall (1*d*) provides other multiple floating chambers (1*g*), to a lesser extent in relation to the chambers (1g); in the area near the central hole (1*d*), threaded holes are provided (1*i*) for the fixation of the basket (1), with screws (P1), to the tube (5).

Eventually, the floating basket (1) may provide floating element (8) in its side, preferably on the external surface, which can be configured by an air bag (8*a*) obtained with the provision of a sector of double wall (8*b*), parallel to the wall (1*a*), or even, an alternative constructive option, one or more floats can be assembled (9) in low density material, such as EPS (Expanded Polystyrene), PU (Polyurethane), among others.

The male upper crown (3) (FIG. 4B), in a preferred construction, comprises a number of engineering plastic, with a cylindrical central sector whose side wall (3*a*) and orthogonal branching (3*b*) form an "L" shape creating multiple equidistant radial dents (3*c*), preferably cylindrical step, and an upper base (3*d*) with a central hole where it accommodates a bushing (B) with an opening grooved (B1) that can be coupled to the ribbed edge (E1) of the drive shaft (E). The branch (3*b*), in the shape of skirt, presents a peripheral radius defined to allow the stability of the male upper crown (3) within the female upper crown (6), at its vertical displacement.

The female upper crown (6) (FIG. 4A), also made of engineering plastics, presents a cylindrical central sector (6*a*), covering the upper base (6*b*) with sized central hole to serve as a cylindrical fitting seat (SC) of the agitator (AG) which, in turn, struts the upper base (3*d*) of the crown (3), preventing its movement; the lower face of the base (6*b*) is provided with multiple radial equidistant dents (6*c*), preferably of cylindrical steps and compatible with the dents (3*c*) of the crown (3). The lower base (6*d*) of the part (6) comprises a cylindrical tab provided with hollow holes (6*e*) which can be passed over by the screws (P2) used for the fixation of the part (6) to the tube (5) (FIG. 2A). The part (6) is provided with external lifting strake of bracing (6*f*).

The female lower crown (4) (FIG. 5A), also made of engineering plastic is constituted by a discoid body, made up by the peripheral skirt (4*a*) with multiple holes (4*b*), passed over by screws (P) for fixing this part to the base of the tub (T) and provides, to the center, a cylindrical sector (4*c*), braced to the skirt (4*a*) through the walls (4*d*); this cylindrical sector (4*c*) is provided with upper flange (4*e*) whose inner face is coated with multiple equidistant radial dents (4*f*), preferably cylindrical steps.

The male lower crown (7) (FIG. 5B) also cylindrical and made of engineering plastic and comprises a central sector (7*a*) with the lower base in the shape of a surrounding skirt (7*b*), whose upper surface is provided with multiple equidistant radial dents (7*c*), preferably of cylindrical and sized steps so as to couple in the dents (4*f*) of the female lower crown (4); the upper base (7*d*) of the cylindrical central sector (7*a*) has multiple small holes (7*e*) distributed in a equidistant way and around a central hole (7*f*), sized to allow the housing, with displacement, of the middle sector of the shaft (E). Between the inner surface of the upper base (7*d*) and the inner wall of the sector (7*a*) are applied the bracing fins (7*g*).

The tube (5) (FIGS. 6A, 6B and 6C) is designed to act as the main element of the clutch (2), once it is fixed to it the female upper crown (6) with screws (P2), the male lower crown (7) with screws (P3), and the floating basket (1), with screws (P1). The tube (5) is made, preferably, of aluminum and is configured by a cylindrical central sector (5*a*) whose side wall includes a longitudinal lowering (5*b*) for engaging and sliding of the latch (1*h*) of the floating basket (1). The upper base (5*c*) of the cylindrical sector (5*a*) is provided with multiple holes (5*d*) that, at the upper sector it fixes the female upper crown (6) with screws (P2) and, in the lower sector, it fixes the male lower crown (7) with screws (P3). The lower base (5*e*) is formed by a skirt also provided with holes (5*f*) for assembling and fixing the floating basket (1). All the internal area of the tube (5) is provided with micro air chambers (5*g*) made up of walls and fins, orthogonal to each other (5*h*).

Therefore, for the washing operation (OPL) (FIG. 7), the tub (T), on principle, contains water (A), the floating basket (1) must be stationary to the tub (T) and the agitator (AG) may fluctuate by imposition of the drive shaft (E) and motor (M). In the case of this embodiment of the present invention, the floating basket (1), according to the floating chambers (1*g*) / (5*g*) and, possibly, the floating element (8) is moved upward (x), carrying the tube (5) with it and consequently, causing the female upper crown (6) to disengage the male upper crown (3) fixed to agitator and the male lower crown (7) also moves upward engaging the female lower crown (4), fixed to the tub (T) (second position).

This displacement (x) upwards (floating) causes the floating basket (1) to remain fixed to the tub (T) (stationary position), while the agitator (AG) is free to perform the oscillating movement, in the washing operation, through the drive shaft (E).

Once the washing water is drained from the tub (T) (see FIG. 8), the floating basket (1) moves vertically (x) and downwards; the tube (5) also moves down carrying with it the female upper crown (6) which engages the male upper crown (3) fixed to the shaft (E), and the male lower crown (7) which disengages the female lower crown (4). Since these parts (3)/(6) are engaged (first position) and the parts disengaged from each other (4)/(7), the basket (1) is coupled to the agitator (AG). As the agitator (AG) starts rotating, the basket is dragged along by the clutch arrangement (2), so that the operation is performed by centrifugation (OPC) by the washing machine.

It is true that when an aspect of the invention is put into practice, modifications may be made with regard to certain details of construction and shapes, without incurring depart from the principles that are clearly substantiated in the set of claims, where it is understood that the terminology used has had the purpose of no limitation.

The invention claimed is:

1. A top-load washing machine comprising:

a washtub, a basket within the washtub, a drive system including a motor and a clutch, and an agitator connected to the clutch, wherein:

the basket is arranged to move vertically along a drive shaft in relation to an amount water in the washtub, wherein when the washtub is drained of water, the basket is in a first position and the washing machine can perform a spinning operation, and when the washtub is filled with water, the basket is in a second position and the washing machine can perform a washing operation;

the clutch comprises an upper part, a lower part, and a connecting member that move together vertically with the position of the basket;

an upper engagement part is attached to the washtub and is arranged above the lower part of the clutch to engage with the lower part of the clutch when the basket is in the second position;

a lower engagement part is attached to the drive shaft and is arranged below the upper part of the clutch to engage with the upper part of the clutch when the basket is in the first position;

when the upper engagement part engages with the lower part of the clutch, the basket is held stationary with respect to the washtub, the agitator can oscillate independently of the basket, and the washing machine can perform the washing operation; and when the lower engagement part engages with the upper part of the clutch, the basket is temporarily affixed to the agitator, the agitator and basket rotate together, and the washing machine can perform the spinning operation.

2. A washing machine according to claim 1, wherein the basket further comprises a perforated wall and a base, the base having a central hole through which the drive shaft passes, and a floating element located at the bottom of the base that comprises a plurality of chambers.

3. A washing machine according to claim 1, wherein the basket further comprises a floating element located at the top of the base.

4. A washing machine according to claim 3, wherein the floating element comprises at least one air chamber.

5. A washing machine according to claim 3, wherein the floating element comprises at least one float made of low density material.

6. A washing machine according to claim 1, wherein the lower engagement part is affixed to remain stationary in relation to the drive shaft.

7. A washing machine according to claim 1, wherein the lower engagement part is configured to engage with the upper part of the clutch while the basket is in the first position, said first position being lower than said second position.

8. A washing machine according to claim 1, wherein the upper engagement part is affixed to remain stationary in relation to the washtub.

9. A washing machine according to claim 1, wherein the lower part of the clutch is affixed to the connecting member, and is configured to engage with the upper engagement part while the basket is in the second position, said second position being higher than said first position.

10. A washing machine according to claim 1, wherein the upper part of the clutch is affixed to the connecting member, and is configured to engage with the lower engagement part, while the basket is in a lower vertical position with respect to the washtub.

11. A washing machine according to claim 1, wherein the connecting member of the clutch is affixed to the upper part of the clutch, the lower part of the clutch, and the basket so that these parts move in together as one unit.

12. A washing machine according to claim 1, wherein the upper part of the clutch engages with the lower engagement part, and the upper engagement part engages with the lower part of the clutch, through meshing rounded grooves.

13. A washing machine according to claim 1, wherein the upper part of the clutch, the lower engagement part, the upper engagement part and the lower part of the clutch are made of a plastic material.

14. A washing machine according to claim 1, wherein the connecting member is aluminum.

15. A washing machine according to claim 1, wherein:

the basket further comprises a base with at least one floating element located at the top of the base and a plurality of chambers located at the bottom of the base;

when the washtub fills with water a buoyancy of the plurality of chambers and at least one floating element moves the basket vertically upward along the drive shaft; and the upper part of the clutch, the lower part of the clutch, and the basket connecting member extending therebetween, move together with the basket as the basket moves vertically up along the drive shaft.

16. A washing machine according to claim 1, wherein:

the basket further comprises a base with at least one floating element located at the top of the base and a plurality of chambers located at the bottom of the base;

when the washtub drains water from the washing machine a buoyancy of the plurality of chambers and at least one floating element moves the basket vertically downward along the drive shaft; and the upper part of the clutch, the lower part of the clutch, and connecting member extending therebetween, move together with the basket as the basket moves vertically down along the drive shaft.

17. A washing machine according to claim 1, wherein:

the upper part of the clutch and the lower engagement part each further comprise a central hole through which the drive shaft passes, and alternating grooves and teeth that extend radially outward from said central hole and circumferentially around said hole so as to provide a pair of male and female members that engage with each other.

18. A washing machine according to claim 1, wherein:

the lower part of the clutch and the upper engagement part each further comprise a central hole through which the drive shaft passes, and alternating grooves and teeth that extend radially outward from said central hole and circumferentially around said hole so as to provide a pair of male and female members that engage with each other.

* * * * *